US005113776A

United States Patent [19]

Knecht

[11] Patent Number: 5,113,776

[45] Date of Patent: May 19, 1992

[54] FLAGSTAFF ATTACHED HALYARD RETAINER

[76] Inventor: Hillary Knecht, 1720 Tiverton, Bloomfield Hills, Mich. 48013

[21] Appl. No.: 704,456

[22] Filed: May 23, 1991

[51] Int. Cl.[5] ..... B63H 9/04

[52] U.S. Cl. ..... 114/102; 114/39.1

[58] Field of Search ..... 114/39.1, 102, 103, 114/89, 90, 92, 94; 52/146, 151

[56] References Cited

U.S. PATENT DOCUMENTS

| | | | |
|---|---|---|---|
| 876,770 | 1/1908 | Brundell | 24/132 |
| 3,418,958 | 12/1968 | Wyatt | 114/89 |
| 4,230,060 | 10/1980 | McCoy | 114/90 X |
| 4,313,391 | 2/1982 | Hall | 114/90 |
| 4,561,373 | 12/1985 | Hackney | 114/89 |
| 4,889,064 | 12/1989 | Rupp, III | 114/89 |

*Primary Examiner*—Edwin L. Swinehart
*Attorney, Agent, or Firm*—Reising, Ethington, Barnard, Perry & Milton

[57] ABSTRACT

A halyard retainer (10) eliminates noise created by the halyard (12) hitting a flagstaff (14) by retaining the halyard (12) at a greater distance than would normally separate the halyard (12) from the flagstaff (14). A base (30) fixedly secures the halyard retainer (10) to the flagstaff (14). The halyard restrictor (24) is at the distal end (20) of an arm (16) and includes two slots (26). The longitudinal portions (28) of the slots (26) allow the halyard retainer (10) to hold the halyard (12) without additional latches or locks. The arm (16) is rotatable about a first pin (42) between an operating position and a storage position and is locked into one of the two positions using a second pin (58).

15 Claims, 2 Drawing Sheets

FLAGSTAFF ATTACHED HALYARD RETAINER

BACKGROUND ART

1. Technical Field

The subject invention relates to cord and rope holders. More particularly, the subject invention relates to a pivoting halyard retainer.

2. Description of Related Art

Flagstaffs and masts are used to support articles, typically made of fabric, high above the reach of man. The flagstaffs and masts, hereinafter referred to as flagstaffs, are thin pole-shaped structures used as unobtrusive structures to support these articles, such as flags, sails, pennants, and the like.

The standard method of hoisting the flag or sail is stringing a rope, or halyard, up through an eye hook at the top of the flagstaff and back down to the ground attaching the flag to the halyard. The halyard is secured at the bottom of the flagstaff via a cleat. The flag is lifted by pulling one half of the halyard down thus pulling the other end of the halyard up through the eye hook. The flag is then lifted up to the top of the flagstaff. When the flag is to be removed, the opposite end of the halyard is pulled.

A problem arises when a wind is present. Noise is produced between the halyard and the flagstaff when the halyard collides with the flagstaff because of it flapping in the wind. This problem becomes particularly bothersome at night because the noise keeps everyone in the vicinity awake. Outside of releasing the halyard to flap freely in the wind presumably away from the flagstaff, which is not a very satisfying solution, for sailors in particular, there is no known remedy.

U.S. Pat. No. 4,313,391 to Hall issued Feb. 2, 1982, discloses a mast shroud system for spreading support the shrouds of a mast to aid in the attachment and removal of the shrouds to and from the mast. Although this system effectively moves the shrouds away from the mast, thus reducing the amount of noise created by the shroud hitting the mast, this system does not contemplate the separation of the halyards from the mast. The shroud system is not capable of handling halyards which must be used, raised and lowered, on a regular basis. The nature of the shrouds are to support the mast and will not be frequently removed. In addition, the mast shroud system must always be used and, therefore, has no need nor even capability to be stored in an unobtrusive position.

U.S. Pat. No. 876,770 to Brundell, issued Jan. 14, 1908, discloses a rope holding device for securing a rope used to open and close curtains. The rope holding device comprises an arm with a notch extending from the interior of the arm out to the periphery of the arm in a direction perpendicular to the longitudinal axis of the arm. The device further includes a spring loaded sleeve which is forced by the spring out over the notch in the arm. Therefore, when the rope is inserted into the notch, the sleeve clamps the rope in place not allowing it to move. Additionally, a support arm is attached to the arm via the sleeve to prevent the arm from rotating due to a force which may be applied to the arm by the clamped rope. A stop prevents the arm and support arm from collapsing against the wall when not in use by restricting the amount of clockwise rotation. This system is inadequate for reducing the amount of noise created by the halyard hitting the flagstaff because a lateral wind is capable of overcoming the lateral force created by the longitudinal force of the spring loaded sleeve. The rope will be subsequently forced out of the holder. The rope holding device is designed for indoor use and is not designed to withstand the forces that it may encounter in an outdoor environment having gusting winds and storms. The rope would be freed from its holder and begin to flap in the wind and, invariably, create the irritating noise of the halyard hitting the flagstaff.

SUMMARY OF THE INVENTION AND ADVANTAGES

A halyard retaining assembly for eliminating noise produced by a halyard colliding with a pole structure comprises arm means. The arm means has a base end and a distal end defining a longitudinal axis therebetween for extending the halyard away from the pole structure. The base means is fixedly securable to the pole structure for supporting the arm means at the base end. Halyard restricting means is disposed adjacent the distal end of the arm means for removably securing the halyard at the distal end of the arm means. Rotating means supports the arm means on the base end for rotating the arm means about the base end relative to the base means. The assembly is characterized by the halyard restricting means including at least one slot having a portion extending substantially parallel to the longitudinal axis.

The assembly eliminates the method of releasing the halyards to fly in the wind by retaining the halyard out and away from the flagstaff thus eliminating any noise which may be produced by the halyard coming into contact with the flagstaff. An added advantage of the subject invention is that it can be rotated to a stored position so it will be visually less obtrusive when it is not as important that the halyards are hitting the flagstaff.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
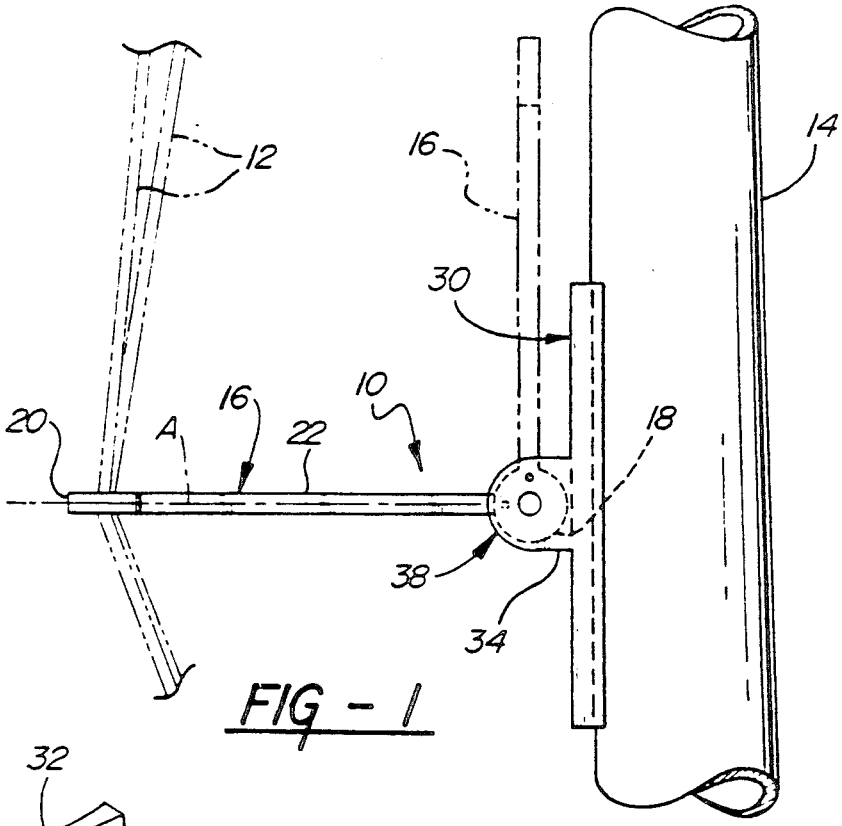
FIG. 1 is a side view of the preferred embodiment of the subject invention.

Referring to the drawings, wherein like numerals indicate like or corresponding parts throughout the several views, the subject invention is a flagstaff attached halyard retainer and is generally shown at 10. The subject invention 10 eliminates the irritating noise created by a halyard 12 hitting a pole structure 14, such as a flagstaff or a mast, due to any wind which may be present. For simplicity, the pole structure 14 will hereinafter be referred to as a flagstaff 14.

The subject invention 10 includes arm means, generally indicated at 18. The arm means 16 has a base end 18 and a distal end 20 with a body 22 extending therebetween defining a longitudinal axis A. The arm means 16 extends the halyard 12 out and away from the flagstaff 14. The arm means 16 does not increase the tension in the halyard 12; it moves the halyard 12 away from the flagstaff 14 a distance greater than the maximum lateral distance the halyard 12 may sway due to external forces such as wind. And because the distance of sway will vary as a function of the distance from a securing structure, i.e., a cleat below or a eye hook above (neither shown), the distance the halyard 12 must be from the flagstaff 14 to prevent these collisions. Therefore, only one arm means 16 is needed so long as the arm means 12 is long enough to separate the halyard 12 from the flagstaff 12 at the securing structures a sufficient distance.

Halyard restricting means 24 is disposed adjacent the distal end 20 of the arm means 16 for removably securing the halyard 12 at the distal end 20 of the arm means 16. The halyard restricting means 24 includes at least one slot 26 having a portion 28 extending substantially parallel to the longitudinal axis A. The portion 28 restricts the movement of the halyard 12 so it may only move in a direction parallel to the longitudinal axis A. In other words, the halyard 12 is abutted on three sides by the halyard restricting means 24 with the remaining forth side free from any abutment with the halyard restricting means 24. The halyard 12, however, can move in this free direction due to the tension created by the halyard 12 being tied down at the cleat (not shown) below. Therefore, the wind cannot blow the halyard 12 out of the halyard restricting means 24 when the wind blows in a direct having a directional component perpendicular to the longitudinal axis A. By having a portion 28 of the slot 26 being parallel to the longitudinal axis A, the subject invention 10 eliminates the need for latches or other movable means of restraining the halyard 12 from moving in a lateral direction.

Figure 2:
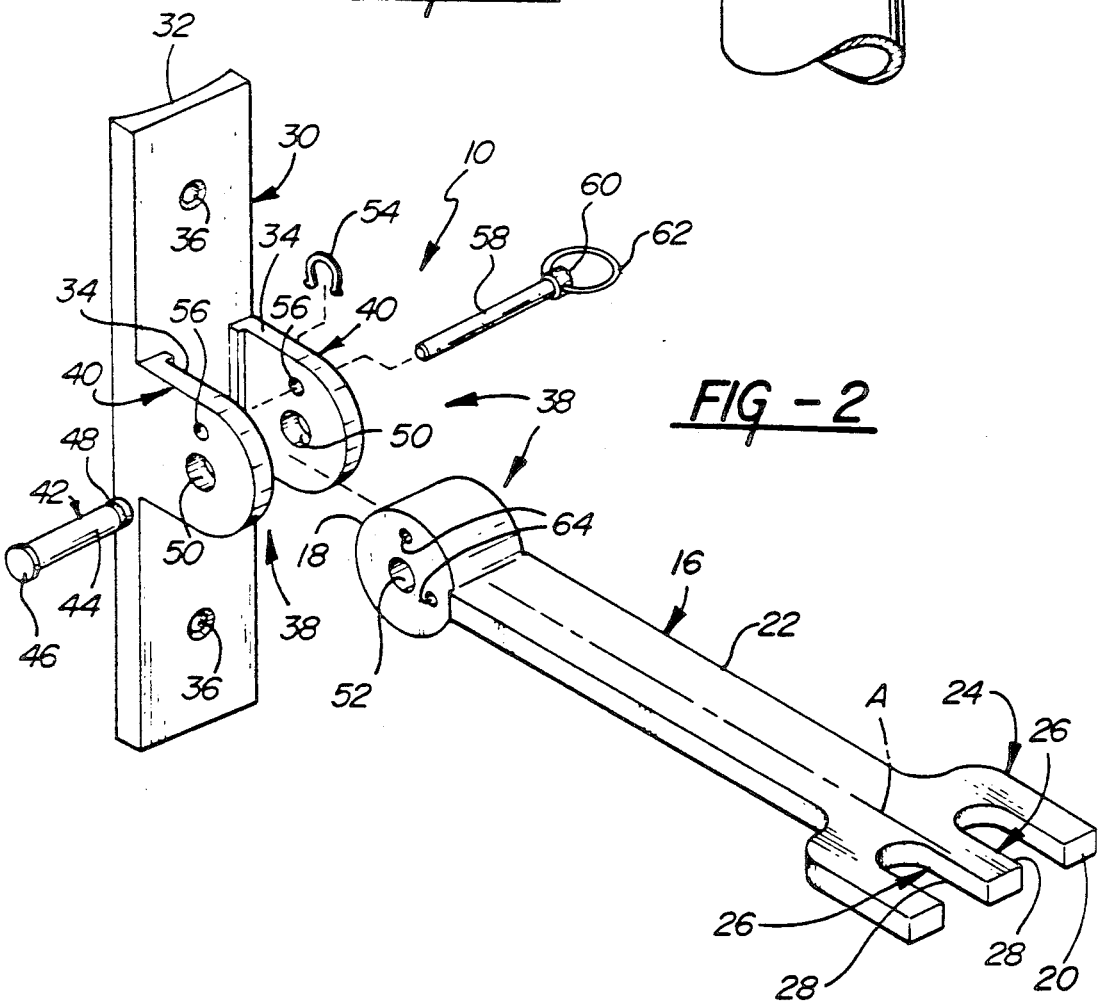
FIG. 2 is an exploded perspective view of the preferred embodiment cf the subject invention.

In the preferred embodiment, as best shown in FIG. 2, the halyard restraining means 24 includes a plurality of slots 26, one for each section of the halyard 12 extending the length of the flagstaff 14. Typically, the halyard 12 extends the length of the flagstaff 14 only twice, to facilitate the raising and the lowering of one article. Therefore, two slots 26 are shown spaced equidistant from the longitudinal axis A in FIG. 2.

In addition, the halyard restricting means 24 is wider than the body portion 22 of the arm means 16. The reduction in the width of the arm means 16 past the halyard restricting means 24 reduces the weight and cost of the subject invention 10 while increasing the ease in mounting same.

The subject invention 10 further includes base means, generally indicated at 30, fixedly securable to the flagstaff 14 for supporting the arm means 16 at the base end 18 of the arm means 16. Because the base means 30 will usually be secured to a flagstaff 14, the base means 30 has an arcuate mounting surface 32 facing oppositely to the flanges 34, discussed subsequently, for fixedly securing the assembly 10 to the flagstaff 14. Although there exists several different means for fastening the base means 30 to the flagstaff 14 known to those skilled in the art, the base means 30 is secured to the flagstaff 14 using sheet metal screws (not shown) which extend through holes 36 in the base means 30. In the preferred embodiment, two holes 36 are shown.

Rotating means, generally shown at 38, supports the arm means 16 at the base end 18 for rotating the arm means 16 about the base end 18. The rotation of the arm means 16 is relative to the base means 30. The rotating means 38 includes holding means, generally indicated at 40, extending out from the base means 30. The rotating means 38 also includes a first pin, generally indicated at 42, which extends through the holding means 40 and the arm means 16. The first pin 42 comprises a solid cylindrical body 44 having a head 46 and a retainer receiving groove 48 at either end of the cylindrical body 44. The first pin 42 is inserted through two holes 50, discussed subsequently, in the holding means 40 and through a second hole 52 in the arm means 16. The head 46 prevents the first pin 42 from passing therethrough. A circlip 54 is inserted into the retainer receiving groove 48 after the first pin 42 is fully inserted into the holding means 40. The retainer receiving groove 48 may be replaced by equivalent retaining structures. By way of example only, alternative retaining structures may include, but are not limited to, a hole and cotter pin combination or a threaded end and nut combination.

The holding means 40 is further characterized by including at least one flange 34 extending out from the base means 30 and having a first hole 50 for receiving the first pin 42. In the preferred embodiment of the subject invention 10, the holding means 40 includes a plurality of flanges 34, namely two flanges 34, which extend out and away from the base means 30 on either side of the arm means 16. Each of the flanges 34 include first receiving means 56 for receiving locking means 58. The first receiving means 56 comprise a hole 56 in each of the flanges 40 which are aligned with each other. Said another way, the first receiving means 56 includes at least one pair of aligned holes extending through the flanges 34.

The locking means 58 locks the arm means 16 in any one of a plurality of rotational positions relative to the base means 30. The locking means includes a second pin 58. The second pin 58 also has a head 60 for restricting the movement of the second pin 58 so it will not move beyond any of the flanges 40. The head 60 may include a ring 62 to aid in the removal of the second pin 58.

The base end 18, and more particularly, the rotating means 38 of the base end 18 further includes second receiving means 64 for receiving the second pin 58 therein. The arm means 16 will be locked into a distinct position when the second pin 58 is inserted through both the first 56 and second 64 receiving means. The second receiving means includes at least one hole 64 extending through the base end 18 of the arm means 16. In the preferred embodiment, a plurality of holes 64 extend through the base end 18 of the arm means 16.

The pair of holes 56 extending through the flanges 40 and the plurality of holes 64 are concentrically disposed about the first pin 42. In addition, they 56,64 are also alignable. In other words, the distance between the center first holes 50 and the pair of holes 56 are equal to each other and equal to the distance between the centers of the second hole 52 and the plurality of holes 64. Therefore, when the arm means 16 is rotated to one of its plurality of positions, i.e., an operating position and a storage position (shown in phantom in FIG. 1), one of the plurality of holes 64 will align with the pair of holes 56. Upon alignment, the second pin 58 may be inserted therein thus locking the arm means 16 in the chosen position.

Figure 3:
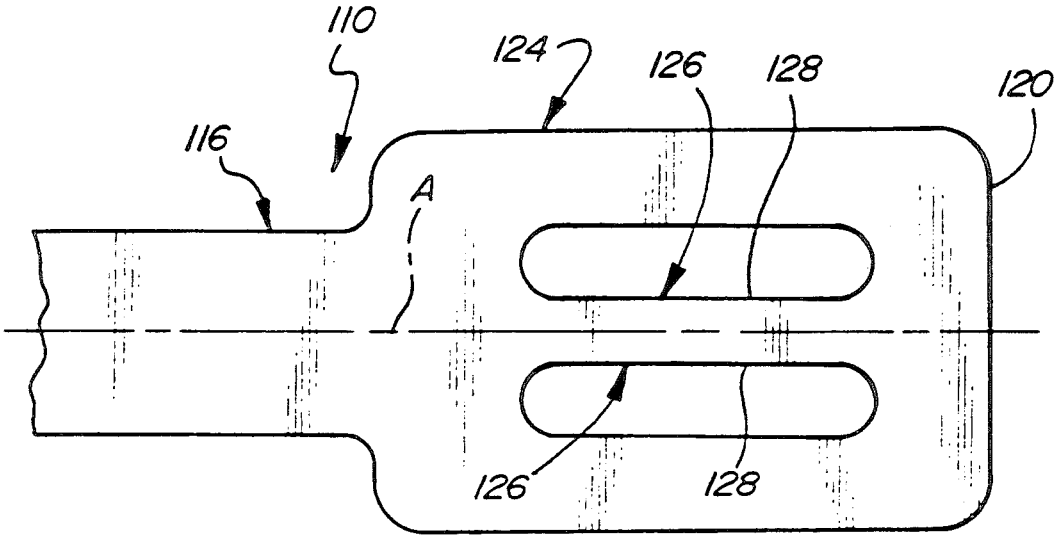
FIG. 3 is a fragmentary plan view of a first alternative embodiment of the subject invention.
Figure 4:
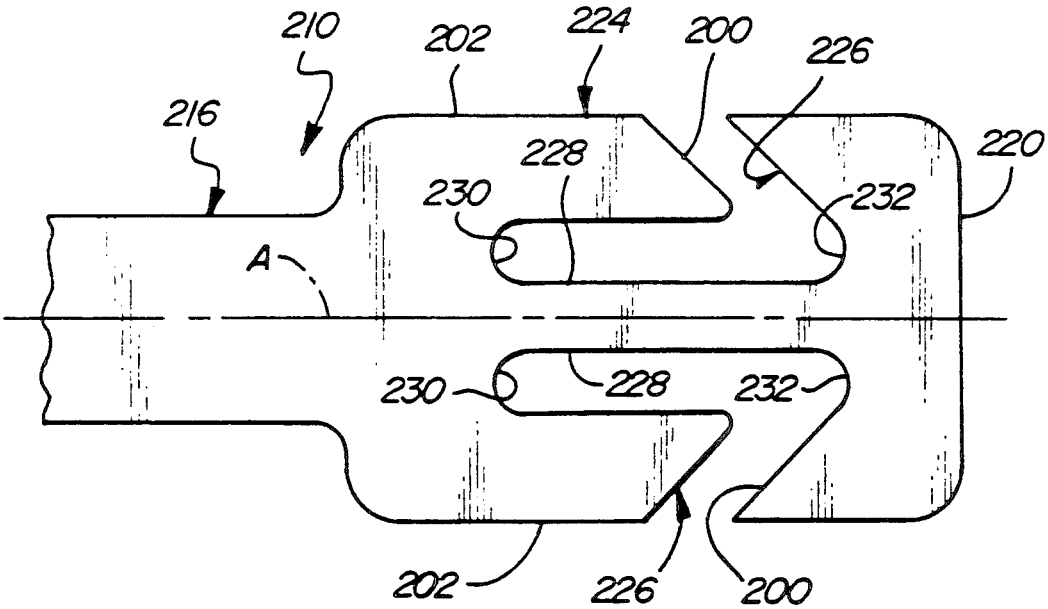
FIG. 4 is a fragmentary plan view of a second alternative embodiment of the subject invention.

Turning attention to FIGS. 3 and 4, where like numerals refer to like or similar parts, two alternative designs for the halyard retaining means 124,224 are shown, respectively. In FIG. 3, the plurality of slots 126, each having a longitudinal portion 128 substantially parallel to the longitudinal axis A, include fully enclosed peripheries. Said another way, the plurality of slots 126 are disposed adjacent the distal end 120 of the arm means 116 such that the plurality of slots 126 are closed. Therefore, the plurality of slots 126 do not come into contact with the periphery of the arm means 116. The distal end 120 is a flat surface in this first alternative embodiment.

In the second alternative embodiment, as shown in FIG. 4, the plurality of slots 226 comprise first 228 and second 200 portions extending laterally with respect to the longitudinal axis A. In other words, the plurality of slots 226 come into contact with or open out at the longitudinal sides 202 of the halyard restraining means 224. The first portions 228 have first 230 and second 232 ends wherein the second ends 232 are disposed adjacent the distal end 220 of the arm means 216. Said another way, the first ends 230 point toward the base end 18 and the second ends 232 point toward the distal end 220. The second portions 200 extend outwardly from the second ends 232. The second portions 200 may extend out laterally toward the longitudinal sides 202 at any angle. Although it is shown in FIG. 4 to be an acute angle with respect to the first portion 228 of the slots 226, the angle may be equal to or greater than ninety degrees. As in the first alternative embodiment, the distal end 220 of the arm means 216 is a flat surface in the second alternative embodiment.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A halyard retaining assembly (10) for eliminating noise produced by a halyard (12) colliding with a pole structure (14), said assembly (10) comprising:

arm means (16) having a base end (18) and a distal end (20) defining a longitudinal axis (A) therebetween for extending the halyard (12) out and away from the pole structure (14), said arm means (16) including halyard restricting means (24) disposed adjacent said distal end (20) of said arm means (16) for removably securing the halyard (12) at said distal end (20) of said arm means (16);

base means (30) fixedly securable to the pole structure (14) for supporting said arm means (16) at said base end (18);

rotating means (38) supporting said arm means (16) at said base end (18) for providing rotational movement of said rm means (16) about said base end (18) relative to said base means (30);

said halyard restricting means (24) including at least one slot (26) having a portion extending substantially parallel to said longitudinal axis (A);

locking means (58) for locking said arm means (16) in any one of a plurality of rotational positions relative to said base means (30), said assembly (10) characterized by said base means (30) including first receiving means (56) for receiving said locking means (58) therein.

2. An assembly (10) as set fort in claim 1 further characterized by said slot (26) extending out to said distal end (20) of said arm means (16).

3. An assembly (10,110) as set forth in claim 1 further characterized by said slot (126) having a fully enclosed periphery.

4. An assembly (10,210) as set forth in claim 1 further characterized by said slot (226) having first (228) and second (200) portions such that said second portion (200) extends laterally with respect to said longitudinal axis (A).

5. An assembly (10,210) as set forth in claim 4 further characterized by said first portion (228) having first end (230) disposed adjacent said base end and second end (232) disposed adjacent said distal end (220) whereby said second portion (200) extends out from said second end (232).

6. An assembly (10) as set forth in claims 2,3, or 5 further characterized by said rotating means (38) including holding means (40) extending form said base means (30) and a first pin (42) extending through said holding means (40) and said arm means (16).

7. An assembly (10) as set forth in claim 6 further characterized by said holding means (40) including at least one flange (34) extending out from said base means (30) and having a first hole (50) for receiving said first pin (42).

8. An assembly (10) as set forth in claim 6 further characterized by including a plurality of flanges (34) extending out from said base means (30) on either side of said arm means (16).

9. An assembly (10) as set forth in claim 8 further characterized by said locking means (58) comprising a second pin (58).

10. An assembly (10) as set forth in claim 9 further characterized by said base end (18) of said arm means (16) having second receiving means (56) for receiving said second pin (58) therein.

11. An assembly (10) as set forth in claim 10 further characterized by said first receiving means (56) including at least one pair of aligned holes (56) extending through said flanges (34).

12. An assembly (10) as set forth in claim 11 further characterized by said second receiving means (64) including at least one hole (64) extending through said base end (18) of said arm means (16).

13. An assembly (10) as set forth in claim 12 further characterized by said second receiving means (64) including a plurality of holes (64) extending through said base end (18) of said arm means (16).

14. An assembly (10) as set forth in claim 13 further characterized by said pair of holes (56) and said plurality of holes (64) being concentrically disposed about said first pin (42).

15. An assembly (10) as set forth in claim 14 further characterized by said base means (30) having a arcuate mounting surface (32) facing oppositely to said flanges (34) for fixedly securing said assembly (10) to the pole structure (14).

* * * * *